United States Patent [19]

Kupsky et al.

[11] 4,124,926

[45] Nov. 14, 1978

[54] EDGE TERMINATIONS FOR GAS DISCHARGE DISPLAY PANEL DEVICE AND METHOD OF MANUFACTURING SAME

[75] Inventors: George A. Kupsky; Douglas L. Santchi, both of State College, Pa.

[73] Assignee: Owens-Illinois, Inc., Toledo, Ohio

[21] Appl. No.: 770,253

[22] Filed: Feb. 18, 1977

Related U.S. Application Data

[62] Division of Ser. No. 642,512, Dec. 19, 1975, Pat. No. 4,039,882.

[51] Int. Cl.[2] ..... H01J 9/32; H01J 9/36

[52] U.S. Cl. ..... 29/25.13; 29/628

[58] Field of Search ..... 264/104, 261; 29/25.13, 29/628; 316/19

[56] References Cited

U.S. PATENT DOCUMENTS

| | | | |
|---|---|---|---|
| 3,778,126 | 12/1973 | Wilson | 316/20 |
| 3,894,024 | 7/1975 | Cherenko et al. | 264/261 |

*Primary Examiner*—Richard B. Lazarus
*Attorney, Agent, or Firm*—Jim Zegeer

[57] ABSTRACT

There is disclosed an improved gas discharge display panel device and process of manufacturing same of the type wherein non-conductive thin glass support substrates for anode and cathode electrodes are joined together by a sealant in a spaced-apart assembly. Printed conductors connected to the anode and cathode electrodes extend through the seal area on the respective anode and cathode substrates, which conductors are dielectric coated extensions of the conductive material constituting the electrode. A conductive silver epoxy is extruded between the plates at each point where a conductor passes through the seal and a solid metallic conductor element is inserted in the conductive silver epoxy at each place on anode or cathode lead exits from the seal area. Thereafter, the silver conductive epoxy is cured to form a conductive adhesive bonding of the metal inserts in place and making very low resistance positive connections between each of the conductors extending through the seal area to external circuitry for the device.

In another embodiment, the electrical conductors which lead through the seal to the anode electrodes are coupled to contact pads on the cathode electrode at a region disposed to the rear of the edge of the anode substrate, the cathode substrate extending beyond the edge of the cathode substrate and carrying the contact pads thereon. This permits the edge of the panel to be universally adaptable to inserted conductors as well as to adapt itself to edge connectors as in conventional printed circuit boards.

2 Claims, 5 Drawing Figures

EDGE TERMINATIONS FOR GAS DISCHARGE DISPLAY PANEL DEVICE AND METHOD OF MANUFACTURING SAME

This is a division of application Ser. No. 642,512, filed Dec. 19, 1975, now U.S. Pat. No. 4,039,882.

BACKGROUND AND BRIEF DESCRIPTION OF THE INVENTION

In Kupsky application Ser. No. 492,994, filed July 30, 1974, now U.S. Letters Pat. No. 3,994,868, issued Mar. 16, 1976 (incorporated herein by reference), there is disclosed an apparatus and system for carrying the leads of the anode electrodes to contact pads on the cathode substrate. Selected ones of the contact pads are connected directly to the cathode electrodes on the cathode substrate with the remaining ones being connected by means of an extruded conductive silver epoxy to anode contact pads on the cathode substrate. In accordance with the present invention, the same extruded conductive silver epoxy connection is utilized to secure conductive metal inserts extending beyond the edge of the panel to provide solderable terminals with respect to an end use device, as, for example, a calculator circuit board.

The advantages of the invention are that positive connections are always assured with respect to the anode and cathode electrodes and the external supply of operating potentials to the display. Moreover, since in the preferred embodiment the substrates are inexpensive thin glass plates, the silver conductive epoxy makes a relatively good bond to the glass as well as to the conductive elements (tin oxide on the anode plate and silver conductors contact pads on the cathode plate) to which it is making connection on the substrate. This assures that the inserted metal extensions are uniformly and solidly secured in place in the panel thereby providing a good mounting device for such panels. At the same time, the use of a conductive silver epoxy with respect to these glass substrates assures that no excessive temperatures are required which would create temperature differentials as in the case of conventional soldering techniques. The contact pads may be on an extended or overhung edge with the metal extensions secured in place thereon by a non-conductive epoxy or other adhesive or a non-conductive clamp. In a modification the top or anode plate has its edge extended beyond the silver conductive epoxy connections, so the panel is universally mountable.

DESCRIPTION OF THE DRAWINGS

The above and other objects, advantages and features of the invention will become more apparent from the following description taken in conjunction with the accompany drawings wherein.

Figure 1:
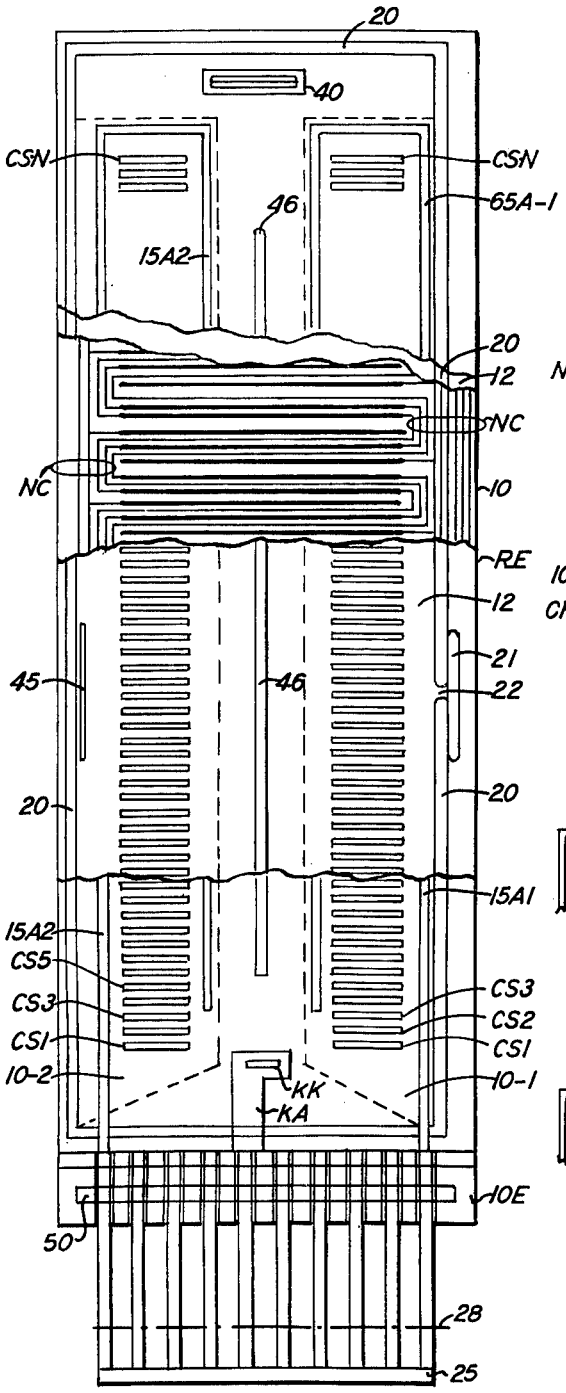
FIG. 1 is a partial top view of a gas discharge display device incorporating the invention.

The cathode electrodes CS, shown as bar elements in FIG. 1, are interconnected in the manner shown in the bottom plan view (FIG. 2) of the display device, it being appreciated that a thin black dielectric layer 12 has been applied over the cathode forming conductive members so only those portions of the cathode segments CS-1, CS-2, CS-3 which are exposed to the gaseous atmosphere in the panel glow with the cathode glow as is conventional in the art. While silver conductive elements are preferred, the invention is not limited thereto. The thin black dielectric layer 12 is shown as extending to the side edges of the cathode substrate in FIG. 1, it being appreciated that this thin layer serves to insulate the cathode electrodes and the non-cathode conductive members NC from the gaseous medium and limit desired light production to only the energized cathode electrodes.

The cathode forming conductor members are connected so as to be cyclically excited by a multiple phase supply, conventional to bar graph displays. In the present embodiment, the cathodes are used to form two side-by-side bar graphs. The cathode segments CS-1, CS-2, CS-3, CS-4, etc. being common in each bar graph display (see the bottom plan view of FIG. 1), the connection pattern by the non-cathode conductive members is laid out so as to avoid crossovers and cross connections by means of vias or other electrical connections through the black dielectric 12. It will be appreciated, however, that the invention is in the edge terminations and is intended to include such cross connections whether formed internally or externally of the gas chamber.

The anode substrate, plate 11, is also a thin glass plate and joined to the cathode plate 10 by spacer sealer 20 all in the manner as disclosed in the above-mentioned Kupsky application. At the same time, the edge of plate 11 is terminated short of the end 10E of cathode plate 10. It will be appreciated that in accordance with the principles of the present invention, the extended end 10E on cathode plate 10 may carry semiconductor drive circuitry or be eliminated so the edges of the anode and cathode plates are coterminus. Of course, the anode plate may overhang the cathode plate, if desired.

The anode plate 11 includes one or more anode elements, one anode element corresponding to each information display area in such panels (alternatively the cathode may be the common element and the anode segmented). In the top plan view shown in FIG. 1, there are two anode elements constituted by transparent conductive tin oxide layers TO-1, TO-2 shown dotted, and a border of silver conductors 15A1 and 15A2, these border conductive elements being printed upon the tin oxide along the border thereof so as not to obstruct the view of the cathode glow at cathode segments CS-1, CS-2 . . . CS-N. It will be appreciated that the gas confined in the device is a gas mixture (neon-argon, with a trace of krypton) which will support cathode glow at appropriate cathode glow pressures. The open loop anode elements 15A1 and 15A2 are outside the discharge area and are for the purposes of lowering the impedance along the anode so that the voltage applied to the tin oxide anodes TO-1 and TO-2 is uniformly applied over all cathode elements shown.

Figure 4:
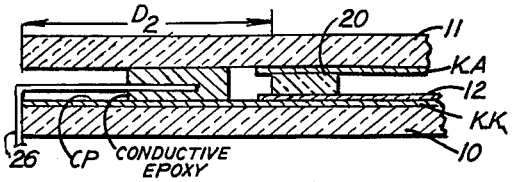
FIG. 4 illustrates the insertion of an edge connector in the edge embodiment of FIG. 3A, Referring now to the drawings, the top plan view of FIG. 1 shows a cathode substrate 10 which may be a thin (about $\frac{1}{8}$ inch thick) glass plate having printed thereon silver conductor leads and cathode segments and/or elements leading out to a terminal edge 10E having a plurality of contact pads CP1, CP2 . . . CPN which, as it will appear more fully hereinafter, are connected to internal cathode and/or anode elements in the display. The particular configurations of cathodes and anodes is not a feature of the present invention, it being understood that the cathodes may be groups of segments in figure eight patterns (as shown in the aforementioned application), arrayed along the cathode plate 10 or may be an array of cathode bars for a bar graph type display, which the top and bottom plan view of FIGS. 1 and 2 show.

Other forms of light passing anodes may be used. The conductive anode elements 15A1 and 15A2 are not normally utilized in segmented type displays of the figure eight type (FIG. 4) because the current flow does not traverse the long distances as is necessary in bar graph type displays. However, there are instances in bar graph displays where the transparent conductive anode has sufficiently low resistance that the voltage drop due to the current flow in the anode is insignificant with respect to maintaining a uniform glow throughout the length of the display and anode conductor elements or bars 15A1 and 15A2 may be eliminated, as they have been in the case of the keep alive system described hereafter.

FIG. 1 also illustrates the keep alive electrode arrangement for a keep alive discharge in the device. In this case, the keep alive anode electrode KA is a conductive tin oxide which does not have the silver conductive portions as described earlier in connection with the information display electrodes. The keep alive cathode electrode is a short bar KK which is exposed through the black dielectric layer 12 to the gaseous medium immediately opposite the anode electrode. The keep alive voltage applied to these electrodes KA and KK assure the presence of sufficient free electrons within the device so as to enable reliable starting of the glow discharge at the respective bar cathodes. Moreover, the cyclical scanning sequence for bar graph displays begin at the lowermost cathodes CS-1 which are nearest the keep alive electrodes. As disclosed in Glaser U.S. Letters Pat. No. 4,024,429 the keep alive voltage may be used as a measure of the quality of the panel.

In accordance with the invention, the spacer sealant 20 is terminated short of the outside edge of anode plate 11 and a distance D (FIG. 3A) beyond the edge of the cathode extension 10E so as to provide a work space. The seal 20 is illustrated as spaced inwardly of the right edge RE (FIG. 1) which provides a notch or nip between plates 10 and 11 for receiving seal rod 21 which fusingley bridges the gas fill port 22.

With the seal 20 spaced inwardly of edge RE some conductors NC lie within the confines of the seal, some under the seal, and some external of the seal. Since they are covered with dielectric 12, they neither glow, interfere with making the seal, nor present any hazard should the right edge of the anode plate be spaced inward of the right edge of the cathode plate.

A number of elongated glass spacer rods, such as the one shown at 45 in FIG. 1, are adhered in place on the cathode substrate 10 by glass frit or dielectric (not shown). Since the cathode substrates are batch processed (in the preferred embodiment), the spacer rods are applied after severance of the glass plates from identical plates and during assembly stage of the cathode and anode substrates 10 and 11 and seal 20. However, the spacer rods 45 could be applied by inserting same in the black dielectric 12 prior to curing same. Moreover, some of the rods may be inside the boundary of seal 20 and some may be outside the boundary of the seal 20, as, for example, in the space at the right edge RE of the device. These spacer rods control the discharge gap distance.

Figure 2:
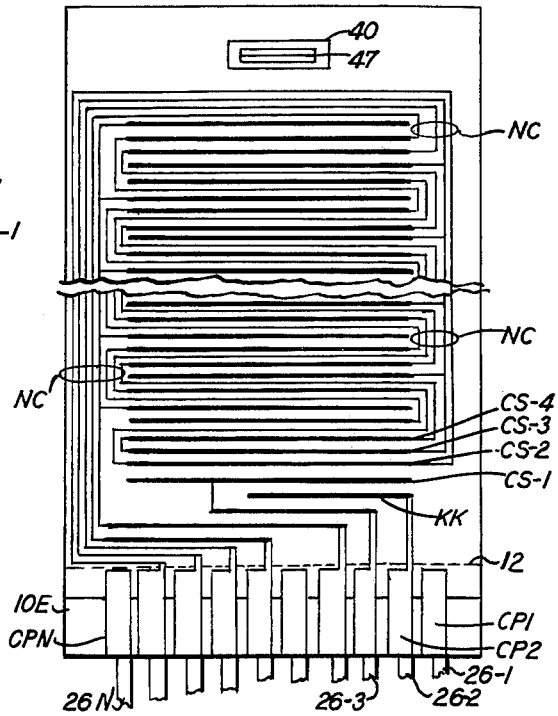
FIG. 2 is a bottom plan view of the gas discharge display device shown in FIG. 1.

In order to assure uniform spacing between the anode electrodes 10-1 and 10-2 and the multiplicity of cathode segments CS for the bar graph device illustrated in FIGS. 1–2, a central rod 46 is provided. This rod is constructed of the same material as the seal and hence is fused to anode plate 11 and the surface of the black dielectric at the same time the seal operation is performed for the seal element 20.

A laser energy transparent window 40 is formed in black dielectric layer 12 and a small mercury filled capillary or giver 47 is adhered in the window by an uncured glass frit or dielectric. After back filling and sealing of the device with the gaseous medium, a beam of laser energy is focused on the capillary or giver, causing the mercury to be released.

THE INVENTION

Figure 3A:
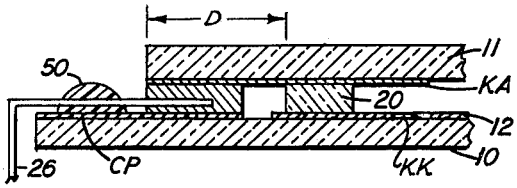
FIG. 3A is a cross sectional view taken on lines *3a—3a* of FIG. 1.
Figure 3B:
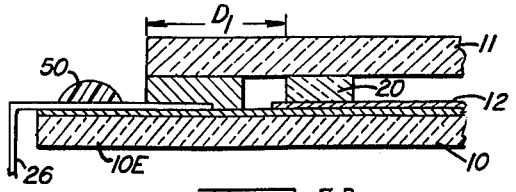
FIG. 3B is a cross sectional view taken on lines *3b—3b* of FIG. 1.

Referring now to the cross sectional views of FIGS. 3A and 3B, it will be noted that FIG. 3A is a cross sectional view taken on the electrode lading to a cathode electrode whereas FIG. 3B leads to an anode electrode. In each case, the electrodes extend through the seal area and the anode leads preferably terminate short of the outside edge of anode plate 11. In the preferred practice of this invention, a carrier strip 25 has a plurality of conductor pins or members 26-1, 26-2 . . . 26-10, one for each anode-electrode contact pad on cathode plate 10, e.g., one for each external connection to the panel device. These carrier strips are preferably formed of tin-phosphor-bronze but beryllium-copper or other conductor carrier strips may be used. Typically, and preferably, these strips are narrower than the width of the conductive contact pads CP. For example, if the contact pads are 0.080 inches wide, the conductor pins 26 are 0.030 inches wide.

A manifold of air-driven hypodermic syringes (not shown), there being one hyperdermic syringe needle at each contact pad CP, is utilized to inject or extrude a closely controlled quantity of silver conductive epoxy into the nip between the two plates. Such conductive epoxy is a conventional, commercially available conductive epoxy, one example being of a product marketed by Epotek under the designation of H-31-D Conductive Epoxy, typically one part epoxy and one part hardener. After injection of the conductive epoxy, the terminal ends of the terminal strips are inserted between the edges of cathode plate 10 and anode plate 11 so that the ends thereof in the nip are substantially completely immersed in the conductive epoxy.

Curing of the epoxy begins immediately but is accelerated by application of heat to the assembly during one of the processing steps utilized in the final sealing of the device or, alternatively, as a separate epoxy curing step. Care is taken that during the curing of the conductive silver epoxy that there are no bubbles formed.

In a typical embodiment, the conductor pads are eighty thousandths of an inch wide and spaced a quarter inch on centers with the conductor strips 26 being approximately 30–35 mils wide and about 12 (12.6mils) mils thick. With the plates 10 and 11 spaced about 20 mils apart, this thickness of conductor strips permits it to be solidly anchored in the nip without high resistance or impedance joints.

A bead of non-conductive epoxy 50 may be applied over the ends of the connector pins for providing an insulating overcoat and further mechanical strength.

The ends 27 of the carrier strip 25 are severed from the carrier per se to provide free conductor ends of conductors 26 which may then be soldered into a conventional printed circuit board or inserted into other connectors for mounting the panel in an end use device. For end use soldering purposes the carrier may be pretinned.

As shown, the conductor elements or pins 26 are flat and have a width somewhat less than the width of the contact pads which assures a good electrical contact between the pads and silver conductive epoxy and also permits some of the silver conductor epoxy during the extrusion of same into the recess between the anode and cathode plates to surround the contact pin and immerse same therein to assure that good electrical contact is made to same and to the contact pads CP as well as to the tin oxide conductors leading to the anode electrodes. The ends of the pins which have been inserted in the recess between the anode and cathode plate are substantially freely received therein. If the conductive epoxy is extruded after insertion of the pins, this size assures that there are no dams and like obstructions during the extrusion of the conductive silver epoxy from the hypodermic manifold. If, as in the preferred embodiment, conductors 26-1, 26-2 . . . 26-N are inserted ater the extrusion of the conductive epoxy, this assures that the epoxy is not spread to the adjoining contact pads. The conductive epoxy has a viscosity such that it does not spread by capillary forces in the nip area between plates.

The hypodermic manifold is controlled by a pneumatic system and pulsed as such to assure that a uniform amount of conductive epoxy is extruded into each recess without overflowing and without making contact between adjacent conductive contact pads CP in the assembly, particularly after immersion of the pins therein.

In FIG. 4A a modification is shown wherein the distance $D_2$ from seal 20 is greater than the distance $D_1$ in FIG. 3A, and the edge extension 10E (FIG. 1) has been deleted. In this case, the conductor pin may be bent around the edge of cathode plate 10. This permits the edge of the panel to be used for other forms of connection.

The present invention is particularly well adapted to fit in with the batch processing technology of gas discharge display panels as disclosed in the above-mentioned Kupsky application. Thus, large numbers of panels with immersed but uncured connector pins may be stacked side-by-side and supplied to an epoxy curing station for simultaneous curing.

It will be appreciated that the contact pads need not be of equal width; that the panel may have other than straight side edges; that edges of the plates may taper to form a larger nip than the discharge gap, and many other variations, obvious to those skilled in the art may be used without departing from the spirit and scope of the invention as defined by the claims appended hereto.

What is claimed is:

1. In a method of making a gas discharge display panel constituted by (A) providing a pair of electrode carrying glass substrates joined in spaced apart relation by a seal to form (1) a thin gas discharge chamber, and (2) at least one notch between said substrates along an edge of the panel, and terminal pads constituted by printed circuit elements electrically connected to electrodes through said seal, and (B) permanently electrically connecting electrodes on one substrate to the terminal pads on the opposite substrate by a silver conductive epoxy, the improvement comprising the steps of (1) extruding a curable liquid silver conductive epoxy element in said notch at all of said pads, and bridging the space between said substrates without shorting to adjacent pads, (2) immersing a solid metal conductive pin into each said curable liquid silver epoxy element extruded in the notch, respectively, at said pads, said pins respectively having a width which is less than the width of the pad at its location, and (3) curing the said curable liquid silver conductive epoxy elements with said solid metal conductive pins immersed therein.

2. The method defined in claim 1 wherein said solid metal conductive pins are connected to a frame and are immersed into all of the extruded conductive elements simultaneously, and severing said pins from said frame after curing of said liquid conductive elements.

* * * * *